US010837634B2

(12) United States Patent
Woodruff

(10) Patent No.: US 10,837,634 B2
(45) Date of Patent: Nov. 17, 2020

(54) TORCH WITH ADJUSTABLE BURN RATE

(71) Applicant: Lamplight Farms Incorporated, Menomonee Falls, WI (US)

(72) Inventor: Robert Woodruff, Oconomowoc, WI (US)

(73) Assignee: Lamplight Farms Incorporated, Menomonee Falls, WI (US)

( * ) Notice: Subject to any disclaimer, the term of this patent is extended or adjusted under 35 U.S.C. 154(b) by 43 days.

(21) Appl. No.: 16/134,531

(22) Filed: Sep. 18, 2018

(65) Prior Publication Data

US 2019/0086076 A1 Mar. 21, 2019

Related U.S. Application Data

(60) Provisional application No. 62/559,901, filed on Sep. 18, 2017.

(51) Int. Cl.
*F23D 3/32* (2006.01)
*F23D 3/18* (2006.01)

(52) U.S. Cl.
CPC . *F23D 3/32* (2013.01); *F23D 3/18* (2013.01)

(58) Field of Classification Search
CPC ..... F23D 3/02; F23D 3/32; F23D 3/28; F23D 3/18
USPC ..... 431/317
See application file for complete search history.

(56) References Cited

U.S. PATENT DOCUMENTS

| | | | | |
|---|---|---|---|---|
| 7,492 | A | 7/1850 | Jennings | |
| 329,589 | A | 11/1885 | Painter | |
| 550,961 | A | 12/1895 | Galtier | |
| 1,028,643 | A | 6/1912 | Vessiere | |
| 1,681,139 | A | 8/1928 | Spear | |
| 2,480,772 | A | 8/1949 | Riemenschneider | |
| 3,236,072 | A | 2/1966 | Goldszmid | |
| 3,663,128 | A | 5/1972 | Yasuda | |
| 4,269,591 | A | 5/1981 | Knoll | |
| 6,196,832 | B1 * | 3/2001 | Mifune | F23O 2/44 126/45 |
| 6,960,320 | B1 | 11/2005 | Smith et al. | |
| 7,083,409 | B2 | 8/2006 | Kuelbs et al. | |

(Continued)

FOREIGN PATENT DOCUMENTS

| | | | |
|---|---|---|---|
| CH | 210285 | A | 9/1940 |
| CN | 201215312Y | U | 4/2009 |

(Continued)

OTHER PUBLICATIONS

International Search Report and Written Opinion for International Application No. PCT/US2018/051561, prepared by the US/ISA dated Dec. 7, 2018.

*Primary Examiner* — Edelmira Bosques
*Assistant Examiner* — Nikhil P Mashruwala
(74) *Attorney, Agent, or Firm* — David G. Woodral; GableGotwals

(57) ABSTRACT

A system includes a torch top having a wick holder extending along a portion of a wick in contact therewith for retaining the wick to extend from a lower side of the torch top to a level above an upper side the torch top. The system includes an adjustment sleeve exterior and concentric to the wick holder and moveable to extend upwardly to such an elevation as to be at least partially above an uppermost portion of the wick holder.

15 Claims, 6 Drawing Sheets

(56) References Cited

U.S. PATENT DOCUMENTS

| | | | | |
|---|---|---|---|---|
| 7,467,944 | B2 * | 12/2008 | Furner | F21V 37/00 431/289 |
| 7,524,339 | B2 * | 4/2009 | Decker | C10L 1/02 431/320 |
| 9,109,797 | B2 | 8/2015 | Chen | |
| 9,920,931 | B2 * | 3/2018 | Hansen | F21V 37/0008 |
| 2009/0162804 | A1 * | 6/2009 | Masterson | B62B 5/04 431/255 |
| 2014/0087318 | A1 | 3/2014 | Chen | |
| 2015/0030988 | A1 * | 1/2015 | Chen | F23D 3/24 431/315 |
| 2015/0153039 | A1 * | 6/2015 | Cremer | F23D 3/24 431/289 |
| 2016/0046889 | A1 * | 2/2016 | Tyson | C11C 5/002 44/275 |
| 2016/0327269 | A1 | 11/2016 | Hansen et al. | |
| 2016/0327270 | A1 | 11/2016 | Hansen | |
| 2017/0261202 | A1 | 9/2017 | Hansen et al. | |

FOREIGN PATENT DOCUMENTS

| | | | | |
|---|---|---|---|---|
| CN | 202132944 | U | 2/2012 | |
| CN | 202253620 | U | 5/2012 | |
| CN | 203431859 | U | 2/2014 | |
| CN | 203464272 | U | 3/2014 | |
| CN | 205191556 | U | 4/2016 | |
| CN | 205825015 | U | 12/2016 | |
| DE | 3110552 | | 4/1982 | |
| EP | 3467379 | A1 * | 10/2019 | F23D 3/28 |
| GB | 19123484 | | 12/1912 | |
| GB | 394683 | | 6/1933 | |
| GB | 854842 | | 11/1960 | |
| JP | 2007315615 | A * | 12/2007 | F23Q 2/06 |
| WO | 2010040155 | A2 | 4/2010 | |

* cited by examiner

414

TORCH WITH ADJUSTABLE BURN RATE

CROSS-REFERENCE TO RELATED CASES

This application claims the benefit of U.S. provisional patent application Ser. No. 62/559,901, filed on Sep. 18, 2017, and incorporates such provisional application by reference into this disclosure as if fully set out at this point.

FIELD OF THE INVENTION

This disclosure is related to liquid fuel burning torches in general and, more specifically, to liquid fuel burning torches with an adjustable flame.

BACKGROUND OF THE INVENTION

Liquid burning fuel torches are used for decoration, lighting, and dispersal of scents and repellants, among other uses. A liquid burning fuel torch may have a separate or integral fuel reservoir where fuel is stored before and during use. Scents or other adjunct compositions may be dissolved in the fuel and/or stored in the reservoir, along with the fuel, until it is drawn into a fire bowl, burner, or other combustion area. The fuel and the adjunct (if present), may both be heated, vaporized, and/or combusted by flame.

Fuel and adjuncts may be drawn from the reservoir to the combustion area by a wick. Thus, the wick may need to extend substantially into the reservoir since loss of contact with the fuel in the reservoir will result in fuel starvation as all remaining fuel is burned from the wick. In many cases, the wick is also part of the combustion system. Flame size and fuel consumption may be controlled, at least in part, by the amount of wick exposed. However, adjustment of the position or elevation of the wick also alters the amount the wick extends into the fuel reservoir.

Wicks can be prepared with an excess length to ensure that they are not likely to be pulled completely from the fuel within the reservoir, even if the flame is adjusted to a high burn rate. However, many wicks are not flexible to the extent that excess length can coil or displace at the bottom of the reservoir without damage to the wick or other torch components, or some loss of functionality. Polycrystalline cotton wicks, and larger wicks associated with large flame torches can be among those whose excess length cannot easily be dealt with (if at all) within the fuel reservoir.

What is needed is a system and method for addressing the above, and other, problems.

SUMMARY OF THE INVENTION

The invention of the present disclosure, in one aspect thereof, comprises a system including a torch top having a wick holder extending along a portion of a wick in contact therewith for retaining the wick to extend from a lower side of the torch top to a level above an upper side the torch top. The system includes an adjustment sleeve exterior and concentric to the wick holder and moveable to extend upwardly to such an elevation as to be at least partially above an uppermost portion of the wick holder.

In some embodiments, the system further comprises an adjustment knob effective to raise and lower the adjustment sleeve. The system may include a pinion in a rigidly fixed relationship with the adjustment knob and a rack affixed to the adjustment sleeve, the rack and pinion operating in response to rotation of the adjustment knob to raise and lower the adjustment sleeve. A shaft may interpose the adjustment knob and the pinion such that the adjustment knob is spaced apart from the adjustment sleeve.

Some embodiments of the system include an enclosure that houses at least a portion of the adjustment sleeve when the sleeve is in a retracted position. The enclosure may encompass at least a portion of the wick holder. The system may comprise a fitting for a fuel reservoir in a fixed relationship with respect to the enclosure. The wick holder, the adjustment sleeve, and the fitting may all be concentric with respect to one another.

In some systems, the enclosure is partially above, and partially below, the fitting. A bracket may be placed on the enclosure affixing a shaft having a pinion affixed thereto to the enclosure, the pinion engaging with the adjustment sleeve to raise and lower the adjustment sleeve by rotation of the shaft. In some embodiments, a spring interposes the bracket and a fastener affixed to the shaft so as to impart friction when the shaft is rotated.

The invention of the present disclosure, in another embodiment thereof, comprises a system having a torch lid providing a wick holder that grips a wick by contact forces along a length of the wick. The system has a flame adjustment sleeve concentric to the wick holder and extendible from a lowered position where at least a portion of the wick is exposed above the wick holder and a raised position wherein the wick is covered by the flame adjustment sleeve above the wick holder. The system also includes a pinion in contact with the flame adjustment sleeve that elevates and lowers the flame adjustment sleeve between the lowered and raised positions when rotated, and a knob for rotating and counter rotating the pinion to raise and lower the flame adjustment sleeve.

In some embodiments, the system further comprises a rack rigidly affixed to the flame adjustment sleeve in a vertical orientation to mesh with the pinion to drive the flame adjustment sleeve in response to rotation and counter rotation of the knob.

An enclosure may be provided encompassing at least a portion of the wick holder and the flame adjustment sleeve. The enclosure may further comprise an upright wall bounded at a top thereof by an enclosure top and on a bottom thereof by an enclosure base. The enclosure top may define an opening sized to permit passage of the wick and elevation and lowering of the flame adjustment sleeve above the enclosure top. A bracket may be affixed to the enclosure and retain a shaft affixed to the pinion such that the pinion remains in contact with the rack. A cutout may be defined in the enclosure top and a portion of the enclosure wall that allows the pinion to remain in contact with the rack inside the enclosure, and allows the rack to extend beyond the enclosure top. An upper platform may interpose the fuel reservoir fitting and the enclosure. The upper platform may bifurcate the enclosure such that the bracket is above the upper platform and a portion of the enclosure extends below the upper platform.

The system may include a fuel reservoir fitting in a fixed relationship with respect to the enclosure. The wick holder, the flame adjustment sleeve, and the fuel reservoir fitting may be concentric with respect to one another.

DETAILED DESCRIPTION OF THE PREFERRED EMBODIMENTS

Figure 1:
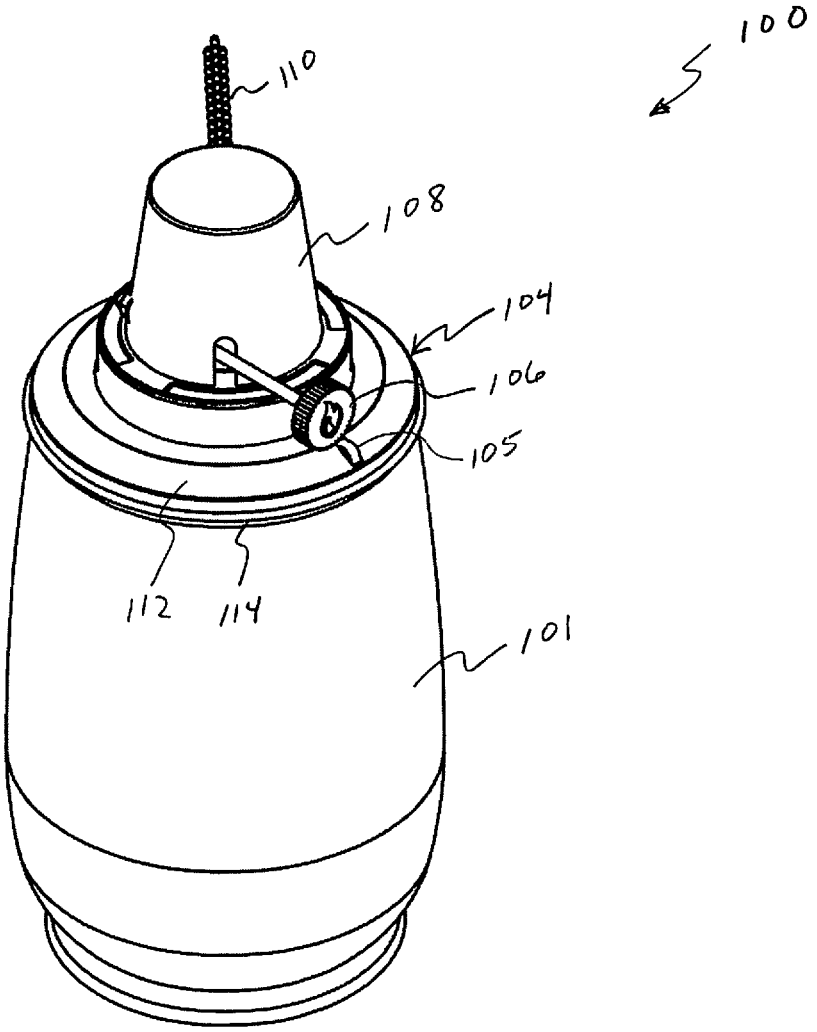
FIG. 1 is a perspective view of a torch according to the present disclosure.
Figure 2:
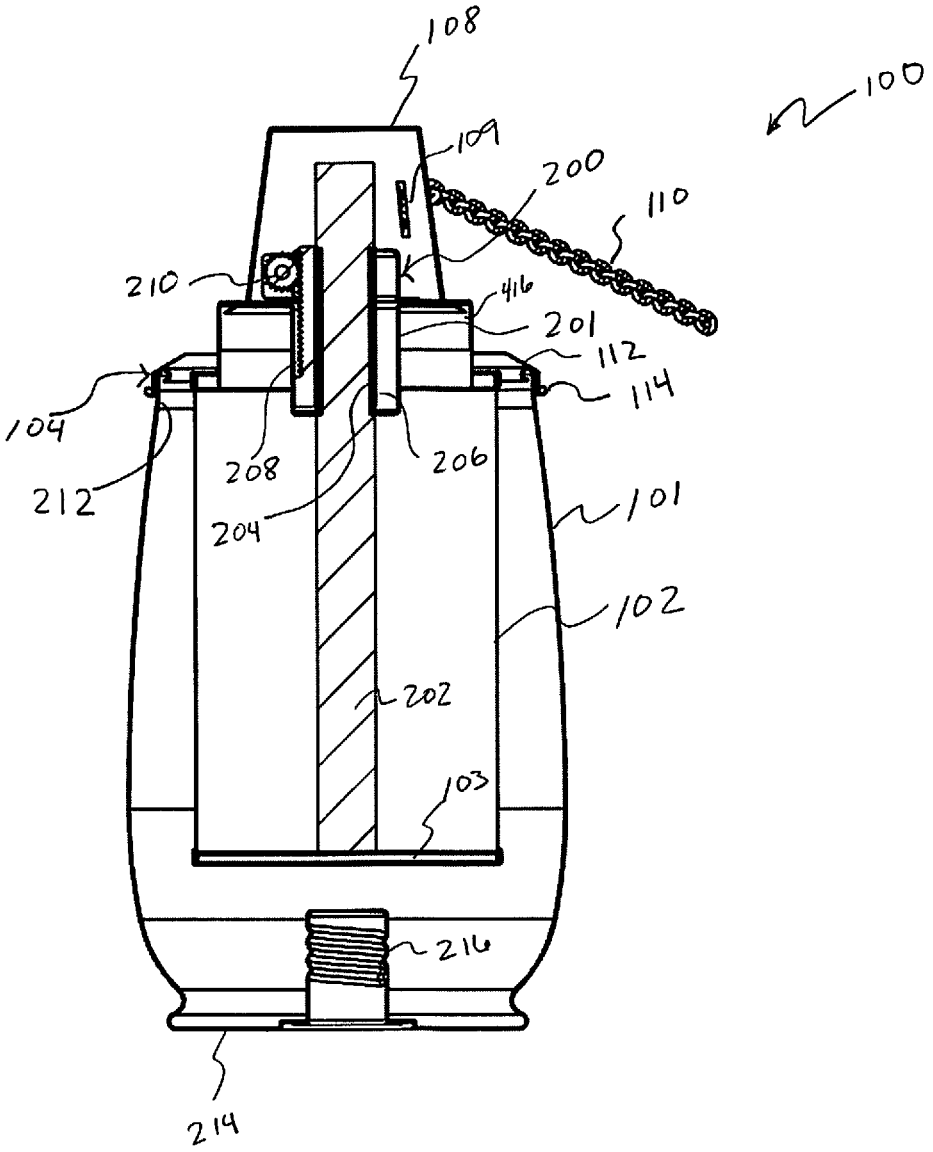
FIG. 2 is a side cutaway view of the torch of FIG. 1.
Figure 3:
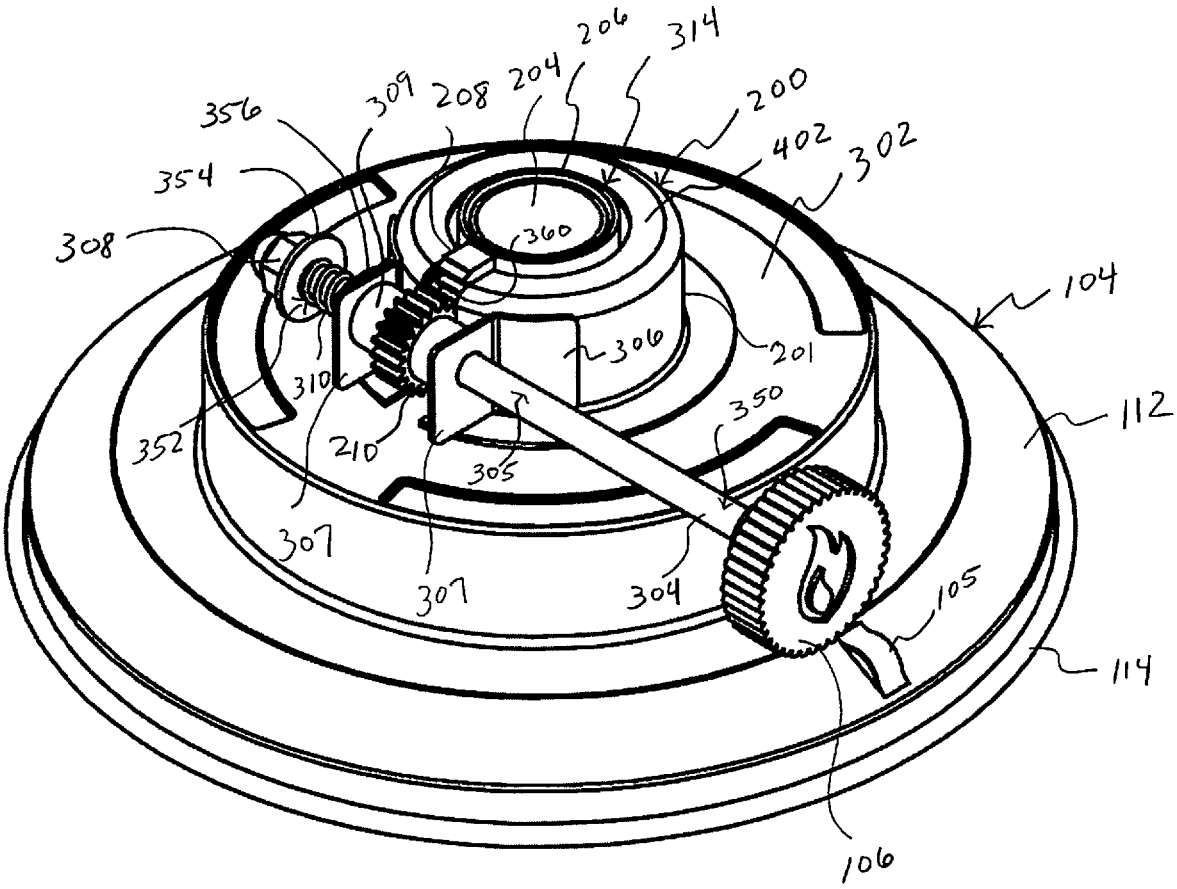
FIG. 3 is a perspective view of a torch top according to the present disclosure.
Figure 4:
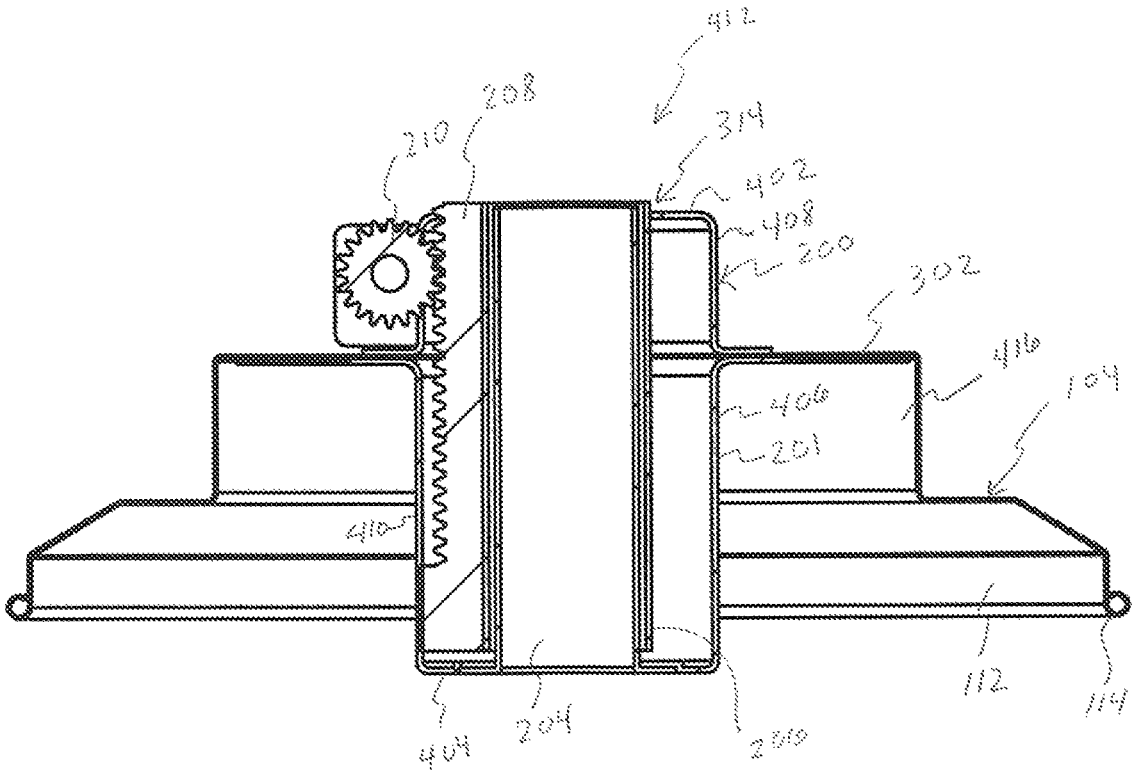
FIG. 4 is a side cutaway view of the torch top of FIG. 3.
Figure 5:
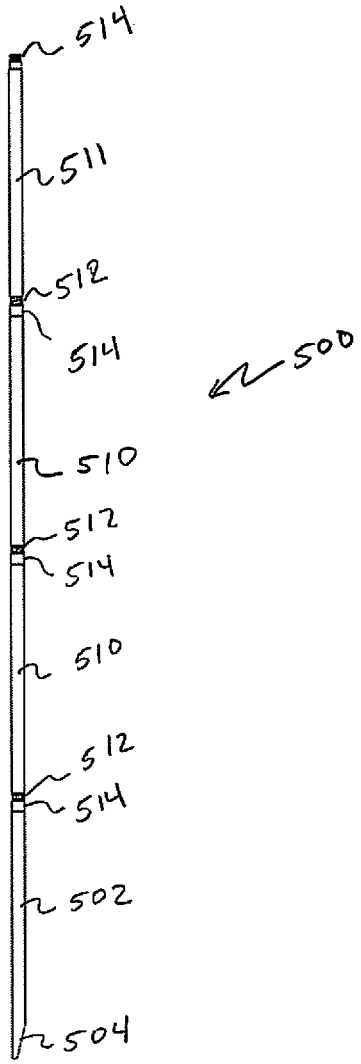
FIG. 5 is a side view of a mounting pole for a liquid fuel burning torch according to aspects of the present disclosure.

Various embodiments of liquid fuel burning torches and associated componentry according to the present disclosure may be illustrated with references to FIGS. 1-5. FIG. 1 is a perspective view of a torch 100 according to the present disclosure. FIG. 2 is a side cutaway view of the torch 100 of FIG. 1. FIG. 3 is a perspective view of a torch top 104 according to the present disclosure. FIG. 4 is a side cutaway view of the torch top 104 of FIG. 3. FIG. 5 is a side view of a mounting pole 500 for a liquid fuel burning torch according to aspects of the present disclosure.

The liquid fuel burning torch 100 may have a fuel reservoir 102 (FIG. 2) with a torch top 104 removably or permanently affixed thereto. The torch top 104 may have a fitting 416 for engaging or retaining the reservoir 102 in a fixed relationship. The fitting 416 may be a friction or interference fitting, or may be threaded or glued in place. The torch top 104 provides a flame adjustment mechanism 200 described further below. The torch top can be considered to comprise a first or upper side 412 and a second or lower side 414 (FIG. 4). The torch top 104 may provide a skirt 112 with a lip or rim 114 that may be used to provide a secure fit to a canister 101 on the lower side 414 of the torch top 104. The skirt 112 may be sized to approximately fit the dimensions of the canister 101 so as to provide a lid to the canister 101 that includes the torch top 104 and fuel insert 102 as a removable combination. In such case, the skirt 112 and/or rim 114 retain the torch top 104 and associated components in a fixed relationship with respect to the canister 101.

The torch top 104 may provide an adjustment knob 106 for adjusting a flame size of the torch 100 without moving or disturbing an associated wick 202 (FIG. 2). The knob may be accessible outside the canister 101 and spaced apart from the wick 202 sufficiently that the knob 106 will not heat up to the point that it is uncomfortable to touch. In some embodiments, the knob 106 is spaced apart from the wick 202 beyond the edge of the torch top 104 (e.g., beyond the skirt 112 or lip 114).

The torch top 104 may provide a cap 108 that can be used to cover the wick 202 and/or the adjustment mechanism 200 when not in use. In some embodiments, the cap 108 is captive to the torch top 104 to prevent misplacement. In some embodiments, a chain 110 retains the cap 108 with the torch top 104. The chain may affix to the cap via chain loop 109 and to the torch top 104 via chain loop 105.

As can be seen in FIG. 2, the wick 202 may be retained in a friction fit in a wick holder 204 forming part of the torch top 104. In some embodiments, the wick holder 204 forms part of the flame adjustment mechanism 200. The wick holder 204 may be stationary with respect to the torch top 104, the rest of the flame adjustment mechanism 200, and/or the fuel reservoir 102. The wick 202 may also remain stationary within the wick holder 204 once it is inserted. The wick holder 204 may be tubular or cylindrical with openings at the top and bottom to pass the wick 202. In some embodiments, there are no other openings on or in the wick holder 204. The wick holder 204 may be formed with such a diameter and length so as to retain the wick 202 along a length thereof with sufficient force to keep the wick 202 from slipping or falling out (e.g., the wick holder 204 grips the wick 202 by contact force along a length thereof). In some embodiments, the wick 202 is still removable or adjustable by a user sliding the wick 202 within the wick holder 204.

The wick 202 may be of a sufficient length to extend to a bottom 103 of the fuel reservoir 102 such that all or substantially all fuel and/or adjuncts within the fuel reservoir can be drawn out for use by the wick 202. The wick may also have sufficient length to extend sufficiently beyond the wick holder 204 that the largest flame desired from the torch 100 would be produced if the wick holder 204 were completely uncovered and/or an adjustment sleeve 206 were completely retracted.

Operation of the adjustment sleeve 206 is described in greater detail below as a component of the adjustment mechanism 200, but here it may be appreciated that the torch 100 provides for larger or smaller flame based on elevation of the adjustment sleeve 206 relative to the wick holder 204 (and, correspondingly, the wick 202). Since the wick 202 may remain stationary with respect to the wick holder 204, the elevation of the adjustment sleeve may control the exposure of the wick 202 during combustion or operation of the torch 100. Exposure of less of the wick 202 provides for a smaller flame, while exposure of more of the wick 202 provides for a larger flame.

In some embodiments, the adjustment sleeve 206 may be retracted such that it does not elevate beyond an uppermost portion of the wick holder 204. The adjustment sleeve 206 may be extendible to various degrees above the wick holder 204. In some embodiments, the wick 202, wick holder 204, and adjustment sleeve 206 may have dimensions that support extension of the adjustment sleeve 206 high enough to act as a snuffer. In various embodiments, such an elevation corresponds to an uppermost portion of the adjustment sleeve 206 extending beyond a maximum height of the wick 202 by twice the diameter of the wick 202, or more.

The adjustment sleeve 206 may be a cylindrical or tubular structure that rides (e.g., moves up and down) on or around the outside of the wick holder 204. In some embodiments, the contour of the adjustment sleeve 206 closely matches or is identical with the contour of the wick holder 204. The adjustment sleeve 206 may have a diameter slightly larger than that of the wick holder 204 such that it is moveable on and around the wick holder 204. In some embodiments the adjustment sleeve 206 has no openings apart from upper and lower openings to pass the wick holder 204 (and wick 202) therethrough.

In some embodiments, a transverse cross section, or diameter (outside) of the wick holder 204 is 0.5 inches or about 0.5 inches. A transverse cross section or diameter (outside) of the adjustment sleeve 206 may be 0.6 inches or about 0.6 inches. In some embodiments, both the wick holder 204 and adjustment sleeve 206 have a height of 1.5 inches or about 1.5 inches. In some embodiments, the wick 202 has an outside diameter of 0.5 inches or about 0.5 inches. Thickness of the walls of the wick holder 204 and the adjustment sleeve 206 may be 0.02 inches or about 0.02 inches. Such dimensions represent one working example of a wick holder 204 that retains the wick 202 adequately without slippage or loss, as well an adjustment sleeve 206 that is capable of moving with respect to the wick holder 204 and wick 202 to effect flame adjustment from large to small, as well as act as a snuffer if the wick 202 does not extend excessively from the wick holder 204.

The wick 202 may be a fiberglass type wick or another type of wick. In some embodiments, the wick 202 has a polycrystalline cotton (PCC) core surrounded by a fiberglass braid or wrap on the exterior. The wick 202 may be a permanent-type wick that is not intended to need replacement during a normal lifespan of the torch 100. A permanent-type wick is not expected to be consumed (e.g., by charring or burning) during use and thus can be produced or cut to a length corresponding to optimal function in the torch 100 without later deterioration of performance. The wick 202 can therefore be long enough to extend all the way, or substantially all the way, to the bottom 103 of the fuel cannister, while also extending sufficiently far beyond the wick holder 204 (when the adjustment sleeve 206 is fully retracted) to produce a maximum flame size. The wick 202 may also be relatively unaffected by the fuel and adjuncts in the fuel so as not to shrink or swell sufficiently to alter performance of the torch 100 over time. The wick 202 is also resistant to charring and other types of combustion-induced degradation as to not need regular trimming, as a traditional cotton wick might, which could impeded or alter performance over time.

As best seen in FIGS. 3-4, the flame adjustment mechanism 200 may comprise an enclosure 201, into which the adjustment sleeve 206 retracts or is stored when lowered, and from which it extends when elevated. The enclosure 201 may further comprise an enclosure wall 406 surrounding the wick holder 204, adjustment sleeve 206, and other components. The enclosure wall 406 may be an upright wall, possibly forming a generally cylindrical structure. The enclosure 204 may also comprise a top 402 and base 404 at opposite top and bottom ends, respectively, of the enclosure wall 406.

The enclosure 200 may be approximately cylindrical, as shown, but other shapes may be utilized provided that they correspond to the remaining components in an operational fashion. There may be some benefit to a cylindrical configuration as this allows the wick holder 204 to retain a tubular or cylindrical wick 202 (which may produce an even flame) and allowing the adjustment sleeve 206 to be generally tubular or cylindrical as well. Thus, in some embodiments, the wick 202, wick holder 204, adjustment sleeve 206, and enclosure 200 are all concentric with respect to one another. The concentricity may continue with an upper platform 302 of the torch top 104 (to which the enclosure 200 may be mounted), the skirt 112, and/or the rim 114. Such a configuration places the wick holder 104 and the adjustment mechanism 200 centrally within the torch top 104 and with respect to the fuel reservoir 102 and/or canister 101. Thus, the general configuration of the torch 100 may be that of a canister 101 containing a fuel reservoir 102 approximately centered (axially) therein, and having a central wick 202 and associated holder 204 and adjustment mechanism 200 near a center top thereof.

In some embodiments, the adjustment mechanism 200 may be partially located above, and partially below, the platform 302 of the torch top 104 to which it is mounted. A superior enclosure portion 408 of the enclosure 201 of the adjustment mechanism 200 may be located above the platform 302, while a lower enclosure portion 410 may extend below the platform 302. As can be seen in FIG. 2, some of the lower enclosure portion 410 may extend partially into the fuel reservoir 102. Such a configuration provides for a lower center of gravity, while allowing the operation of the adjustment mechanism 200 without additional openings into the fuel reservoir. Operation of the flame adjustment mechanism 200 is explained in more detail below, but the exterior controls (e.g., the adjustment knob 106) can be seen with reference to FIGS. 2-3 to allow elevation and lowering of the adjustment sleeve 206 from outside the bounds of the torch top 104 and fuel reservoir 102.

The elevation of the adjustment sleeve 206 is controlled by a user by rotation or counter rotation of the adjustment knob 106. The adjustment knob 106 may be affixed to a first end 350 of a shaft 304, which has a gear or pinion 210 affixed with respect to a medial portion 305 thereof (though, as shown, not necessarily dead center). The pinion 210 interacts or meshes with a rack 208 affixed vertically to the adjustment sleeve 206. The pinion 210 acts as a toothed wheel rolling along a toothed track (e.g., rack 208) that elevates or lowers the adjustment sleeve 206 in response to rotation of the adjustment knob 106.

The shaft 304 and pinion 210 may be retained in proper location (e.g., the pinion 210 enmeshed with the rack 208) by a bracket 306 affixed to the superior enclosure portion 408. The bracket 306 may comprise one or more tabs 307 extending from the superior enclosure portion 408 through which a portion of the shaft 304 passes. The tabs 307 may be oriented such that the shaft 304 is oriented perpendicularly with respect to the adjustment sleeve 206 and rack 208. As shown, two tabs 307 are located on either side of the pinion 210 thereby retaining it in proper location. A sleeve 309 or bushing may be affixed to the shaft 304 to provider proper spacing between the tabs 307 to keep the pinion 210 properly enmeshed to the rack 208.

In some embodiments, an opposite end of the shaft 304 from the adjustment knob 106 is provided with a fastener 308. The fastener 308 may comprise a nut affixed to a threaded end 352 of the shaft 304 may retain a spring 310, possibly between two washers 352, 354. The spring 310 may provide friction and/or pressure between the tab 307 and the fastener 308 so as to reduce or eliminate the possibility of the adjustment sleeve 206 retracting without intentional adjustment via rotation of the adjustment knob 106 by a user.

From FIG. 3, in particular, the superior enclosure portion 408 of the enclosure 201 can be seen to define an opening 314 in the enclosure top 402 from which the adjustment sleeve 206 is allowed to extend. The opening 314 maybe generally circular in conformity with a cylindrical adjustment sleeve 206 but could have other shapes that cooperate with the adjustment sleeve 206. In the present embodiment the opening 314 is concentric or approximately concentric with respect to the adjustment sleeve 206 and/or the wick holder 204.

In some embodiments, a portion of the rack 208 may extend above the enclosure top 402 (in retracted and/or extended configurations of the adjustment sleeve 206). Additionally, the rack 208 may extend radially beyond enclosure wall 406 and/or the pinion 210 may extend radially inward past the enclosure wall 406 in order to mesh properly for adjustment. A cutaway 360 may be defined in the enclosure top 402 and/or the enclosure wall 406 to accommodate such operations. As shown, the cutaway 360 is defined in the enclosure top 402 and only a portion of the enclosure wall 406 corresponding to the superior enclosure portion 408 to allow the pinion to intrude slightly as can be seen in FIG. 4. In the embodiment shown, the cutaway 406 is also into the enclosure top 402 (extending from the opening 314) to allow a portion for the rack 208 to extend with the adjustment sleeve 206.

The materials comprising the components of torch top 104 may include heat resistant steels. The materials may be sheet metals that are cut and bent into shape and possibly welded, folded, or glued together. In some embodiments, various components comprise sheet metal with a thickness of 0.02 inches or about 0.02 inches. Materials may also comprise cast or machined materials. The fuel reservoir 102 may comprise a metal, polymer, or glass. The cannister 101 may comprise metal, polymer, glass, ceramics, treated wood, bamboo, or other materials.

In some embodiments, the canister 101 provides a fitting 216 in, or attached to, a base 214 thereof. The fitting 216 may be threaded or include other securement means. As shown in FIG. 5, a segmented support pole 500 may be provided for mounting the canister 101, and torch 100, securely to a ground surface. Lower pole segment 502, intermediate pole segments 510, and upper pole segment 511 may comprise natural products such as bamboo or wood, or engineered products such as polymers or metals.

The lower pole segment 502 may have a spike 504 on a lower end thereof. The spike 504 may be a continuation of the material of the lower pole segment 502 or may comprise a different, possibly more resilient material. The spike 504 may be driven into a ground surface, or mounted into a secure platform (not shown) for securement of the remainder of the support pole 500 and/or torch 100.

Opposite the spike 504 on the lower pole segment 502 may be a fastener half such as a threaded male connector 514. Intermediate pole segments 510 may have cooperating fastener halves including threaded female connectors 512 and opposite threaded male connectors 514. Thus the lower pole segment 502 and intermediate pole segments 510 may be joined together to form a continuous support pole 500. Atop the final or uppermost intermediate segment 510 may be the upper pole segment 511. The upper pole segment 511 may have upper and lower fastener halves 514, 512, respectively. The upper fastener half 514 of the upper pole segment 511 may be configured to fit into and secure with the fitting 216 in the bottom 214 of the cannister 101. In some embodiments, the fitting 216 has the same or similar thread sizes as the female threaded connectors 512. In such case, the upper pole segment 511 may be substantially similar or identical to the intermediate pole segments 510.

It should be appreciated that the male and female connectors 514, 512 could be reversed (with the same holding true for the fitting 216). It should also be appreciated that the pole segments 502, 510, 511 may have the same or different lengths. An overall height of the support pole 500 may be adjusted by inclusion or more or fewer segments 510. It should also be appreciated that a single segment pole (not shown) could be used that incorporates the fastener half 514 to connect to the fitting 216 and/or the spike 504.

Figure 6:
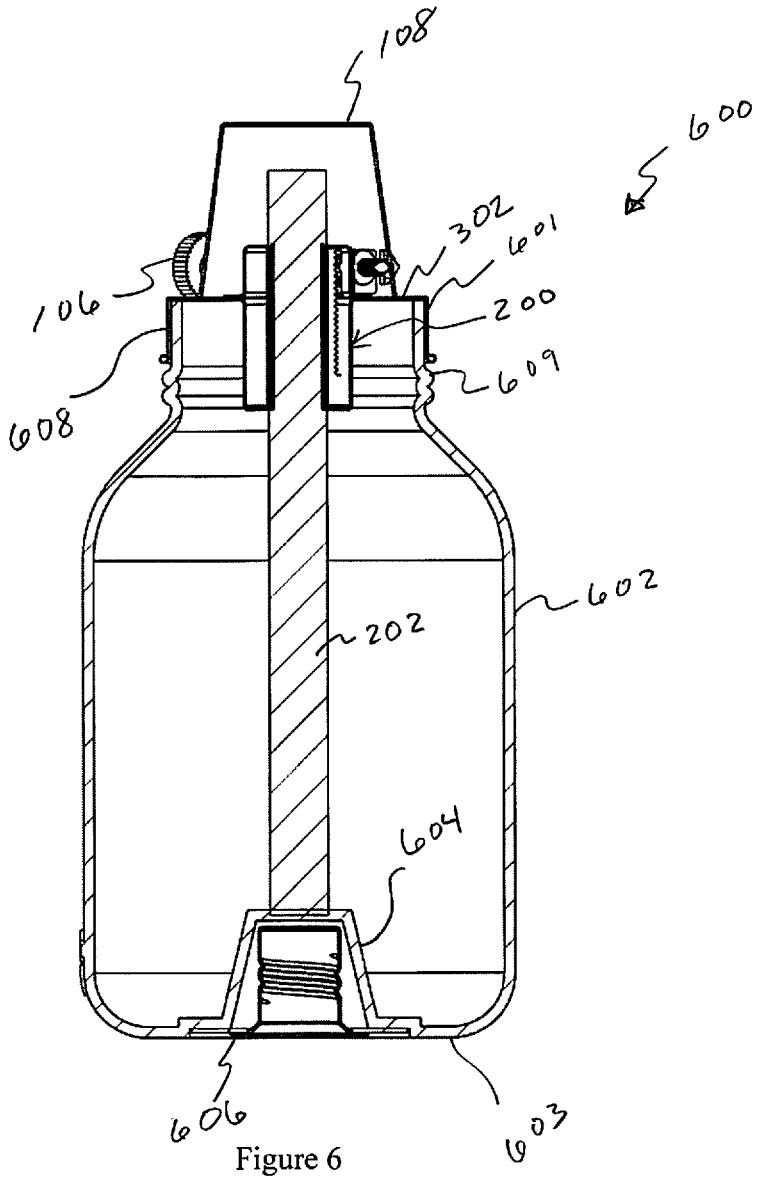
FIG. 6 is a side cutaway view of another torch according to the present disclosure.

Referring now to FIG. 6 a side cutaway view of another torch 600 according to the present disclosure is shown. The torch 600 comprises a fuel reservoir 602 that does not fit into an additional canister (e.g., canister 101 above). The reservoir 602 may comprise glass that may be clear, opaque, colored, or otherwise decorative. Other decorative materials may also be used (e.g., ceramics) for the fuel reservoir 602. An inlet 604 may be provided or defined in a base 603 of the fuel reservoir 602 for receiving a fitting 606. The fitting 606 may be affixed within the inlet 604 by an adhesive or other means. The fitting 606 may define a female threaded connector and therefore function in a similar manner as fitting 216 (FIG. 2, torch 100).

A torch top 601 may attach directly to the fuel reservoir 602 at a neck 609. The neck 609 may be threaded or smooth. The torch top 601 may attach to the neck 609 with a fitting 608 having a shape to cooperate with the neck 609. In some embodiments, the fitting 608 provides an interference fit or a friction fit with the neck 609. In other embodiment, the fitting 608 may secure to the neck 609 with an adhesive. The remainder of the torch top 601 functions in a substantially similar or identical fashion as the torch top 104 described above.

The torch top 601 includes flame adjustment mechanism 200, described above. Here, the flame adjustment mechanism 200 affixes to upper platform 302 of the torch top 601 that connects to the fitting 608. Here again, the arrangement between the flame adjustment mechanism 200 and the remainder of the torch top 601 may be of axial concentricity or substantial axial concentricity. The torch top 601 may be configured to be axially concentric with respect to the fuel reservoir 602. Again, the user may adjust the adjustment mechanism 200 via knob 106 with the operation occurring as described previously above. Cap 108 may be provided for covering the torch top 106, generally, or the adjustment mechanism 200, particularly, when the torch 100 is not in use.

It will be appreciated that the torch 600 may be affixed to the support pole 500 (FIG. 5) previously described. Both torches 100, 600, and the variants discussed herein, may also function as decorative table top torches by resting on their respective bases 214, 603 since the fittings 216, 606 are recessed into the cannister 101 and reservoir 602, respectively.

It should be understood that, in some embodiments, additional components may be included as part of the systems or torches (100, 600) of the present disclosure. However, in other embodiments, components that are not shown or described are excluded. Further, the scope of the appended claims may dictate that some components shown or described are also excluded.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional elements.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A system comprising:

a torch top having a wick holder extending along a portion of a wick in contact therewith for retaining the wick to extend from a lower side of the torch top to a level above an upper side of the torch top;

an adjustment sleeve exterior and concentric to the wick holder and moveable to extend upwardly to such an elevation as to be at least partially above an uppermost portion of the wick holder; and an enclosure that houses at least a portion of the adjustment sleeve when the sleeve is in a retracted position;

a fitting for a fuel reservoir in a fixed relationship with respect to the enclosure wherein the enclosure encompasses at least a portion of the wick holder;

wherein the enclosure is partially above, and partially below, the fitting.

2. The system of claim 1, further comprising an adjustment knob effective to raise and lower the adjustment sleeve.

3. The system of claim 2, further comprising a pinion in a rigidly fixed relationship with the adjustment knob and a rack affixed to the adjustment sleeve, the rack and pinion operating in response to rotation of the adjustment knob to raise and lower the adjustment sleeve.

4. The system of claim 3, further comprising a shaft interposing the adjustment knob and the pinion such that the adjustment knob is spaced apart from the adjustment sleeve.

5. The system of claim 1, wherein the wick holder, the adjustment sleeve, and the fitting are all concentric with respect to one another.

6. The system of claim 1, further comprising a bracket on the enclosure affixing a shaft having a pinion affixed thereto to the enclosure, the pinion engaging with the adjustment sleeve to raise and lower the adjustment sleeve by rotation of the shaft.

7. The system of claim 6, further comprising a spring interposing the bracket and a fastener affixed to the shaft so as to impart friction when the shaft is rotated.

8. A system comprising:

a torch lid having a wick holder that grips a wick by contact forces along a length of the wick;

a flame adjustment sleeve concentric to the wick holder and extendible from a lowered position where at least a portion of the wick is exposed above the wick holder and a raised position wherein the wick is covered by the flame adjustment sleeve above the wick holder;

a pinion in contact with the flame adjustment sleeve that elevates and lowers the flame adjustment sleeve between the lowered and raised positions when rotated;

a knob for rotating and counter rotating the pinion to raise and lower the flame adjustment sleeve; and an enclosure encompassing at least a portion of the wick holder and the flame adjustment sleeve;

wherein the enclosure further comprises an upright wall bounded at a top thereof by an enclosure top and on a bottom thereof by an enclosure base.

9. The system of claim 8, further comprising a rack rigidly affixed to the flame adjustment sleeve in a vertical orientation to mesh with the pinion to drive the flame adjustment sleeve in response to rotation and counter rotation of the knob.

10. The system of claim 8, wherein the enclosure top defines an opening sized to permit passage of the wick and elevation and lowering of the flame adjustment sleeve above the enclosure top.

11. The system of claim 10, wherein the enclosure has a bracket affixed thereto that retains a shaft affixed to the pinion such that the pinion remains in contact with the rack.

12. The system of claim 11, further comprising a cutout defined in the enclosure top and a portion of the upright wall that allows the pinion to remain in contact with the rack inside the enclosure, and allows the rack to extend beyond the enclosure top.

13. The system of claim 12, further comprising a fuel reservoir fitting in a fixed relationship with respect to the enclosure.

14. The system of claim 13, wherein the wick holder, the flame adjustment sleeve, and the fuel reservoir fitting are concentric with respect to one another.

15. The system of claim 14, further comprising an upper platform interposing the fuel reservoir fitting and the enclosure, the upper platform bifurcating the enclosure such that the bracket is above the upper platform and a portion of the enclosure extends below the upper platform.

* * * * *